United States Patent [19]

Murrer et al.

[11] Patent Number: 4,967,305

[45] Date of Patent: Oct. 30, 1990

[54] ELECTRONIC DOOR LOCK APPARATUS, SYSTEM AND METHOD

[75] Inventors: Edward S. Murrer, Redwood City; Mir A. Imran, Palo Alto, both of Calif.

[73] Assignee: DataTrak, Inc., Mountain View, Calif.

[21] Appl. No.: 294,384

[22] Filed: Jan. 6, 1989

[51] Int. Cl.[5] ..... E05B 49/00; E05B 47/00

[52] U.S. Cl. ..... 361/172; 70/219; 70/278; 340/825.31

[58] Field of Search ..... 361/171, 172, 181, 175; 70/219, 278; 340/825.31, 825.32, 825.56; 307/66, 40, 115

[56] References Cited

U.S. PATENT DOCUMENTS

| | | | |
|---|---|---|---|
| 2,810,066 | 10/1957 | Green | 361/181 X |
| 3,870,877 | 3/1975 | Tolbird | 250/209 |
| 4,148,092 | 4/1979 | Martin | 361/172 |
| 4,342,210 | 8/1982 | Denningham | 70/278 |
| 4,411,144 | 10/1983 | Aydin | 70/278 |
| 4,713,555 | 12/1987 | Lee | 307/66 |
| 4,766,746 | 8/1988 | Henderson et al. | 70/63 |
| 4,777,556 | 10/1988 | Imran | 361/155 |
| 4,854,143 | 8/1989 | Carder et al. | 70/218 |

*Primary Examiner*—A. D. Pellinen
*Assistant Examiner*—David Osborn
*Attorney, Agent, or Firm*—Flehr, Hohbach, Test, Albritton & Herbert

[57] ABSTRACT

Electronic door lock system for use with a door mounted in a door frame and has a dead bolt and a latch mounted on the door. A control unit is mounted on the door in the vicinity of the dead bolt and the latch and includes a battery and electronic circuitry connected to the battery and manually operable contacts for selectively operating the dead bolt and the latch so that they can be moved to unlatched positions under the control of first and second hand-operated members.

19 Claims, 5 Drawing Sheets

ELECTRONIC DOOR LOCK APPARATUS, SYSTEM AND METHOD

This invention relates to an electronic door lock apparatus, system and method and more particularly to an electronic door lock apparatus, system and method which is particularly suited for the residential and office markets.

In U.S. Pat. No. 4,148,092 there is disclosed an electronic combination door lock with dead bolt sensing means for the residential market. The electronic combination door lock therein disclosed is comprised of a self-contained battery operated keyboard actuated electronic circuitry for operating restraining means for selectively preventing retraction of the dead bolt. Such an electronic combination door lock has a number of disadvantages. For example, it fails to provide security in the event of battery failure. In addition the particular mechanism therein disclosed has a number of disadvantages. There is therefore a need for a new and improved door lock apparatus system and method.

In general, it is an object of the present invention to provide an electronic door lock, apparatus, system and method incorporating the present invention which is self-contained and which is particularly adapted for the residential and office markets.

Another object of the present invention is to provide an apparatus, system and method which can be used solely with a dead bolt mechanism or solely with a latch mechanism or with both the latch mechanism and the dead bolt mechanism on a single door.

Another object of the invention is to provide an apparatus, system and method of the above character in which a built-in key pad is provided.

Another object of the invention is to provide an apparatus, system and method of the above character in which visual and/or audio feedback is provided.

Another object of the invention is to provide an apparatus, system and method of the above character which is programmable by the owner.

Another object of the invention is to provide an apparatus, system and method of the above character which makes it possible to utilize the same with conventional openings in doors so that it can be utilized to replace existing mechanical dead bolts and latch mechanisms.

Another object of the invention is to provide an apparatus, system and method of the above character in which timed lockouts can be provided.

Another object of the invention is to provide an apparatus, system and method in which entries made through the system ca be recorded and downloaded.

Another object of the invention is to provide an apparatus, system and method in which the outside knob of the dead bolt or the door latch rotates freely when the door is in a locked condition to prevent tampering.

Another object of the invention is to provide an apparatus, system and method in which switch means is provided and is effected by the knob to provide a visual indication in the display when the dead bolt is locked or unlocked.

Another object of the invention is to provide an apparatus, system and method of the above character in which switch means is provided to inform the microprocessor that the knob has been operated to move the dead bolt or latch in an extended or retracted position.

Another object of the invention is to provide an apparatus, system and method of the above character in which the key pad is illuminated when ambient light is below a predetermined level and when the control box is touched by human hand to permit operation of the same in darkness.

Another object of the invention is to provide an apparatus, system and method of the above character in which two batteries are utilized and in which the capabilities of each of the two batteries is checked each time the apparatus is placed in operation.

Another object of the invention is to provide an apparatus, system and method of the above character in which the microprocessor is always connected to the battery having the higher voltage.

Another object of the invention is to provide an apparatus, system and method of the above character which utilizes a microprocessor which can provide three levels of access code which are easily programmable by the owner including a master code, access codes and a one-time access code.

Another object of the invention is to provide an apparatus, system and method of the above character in which a 24 hour lock-out capability can be provided.

Another object of the invention is to provide an apparatus, system and method of the above character in which the date and time can be displayed.

Another object of the invention is to provide an apparatus, system and method of the above character in which a programmable lock-out can be provided.

Another object of the invention is to provide an apparatus, system and method of the above character in which it is possible to record the time and date of entry and in which a last predetermined number of entries can be downloaded to an external computer or other suitable equipment.

Additional objects and features of the invention will appear from the following description in which the preferred embodiments are set forth in detail in conjunction with the accompanying drawings.

Figure 1:
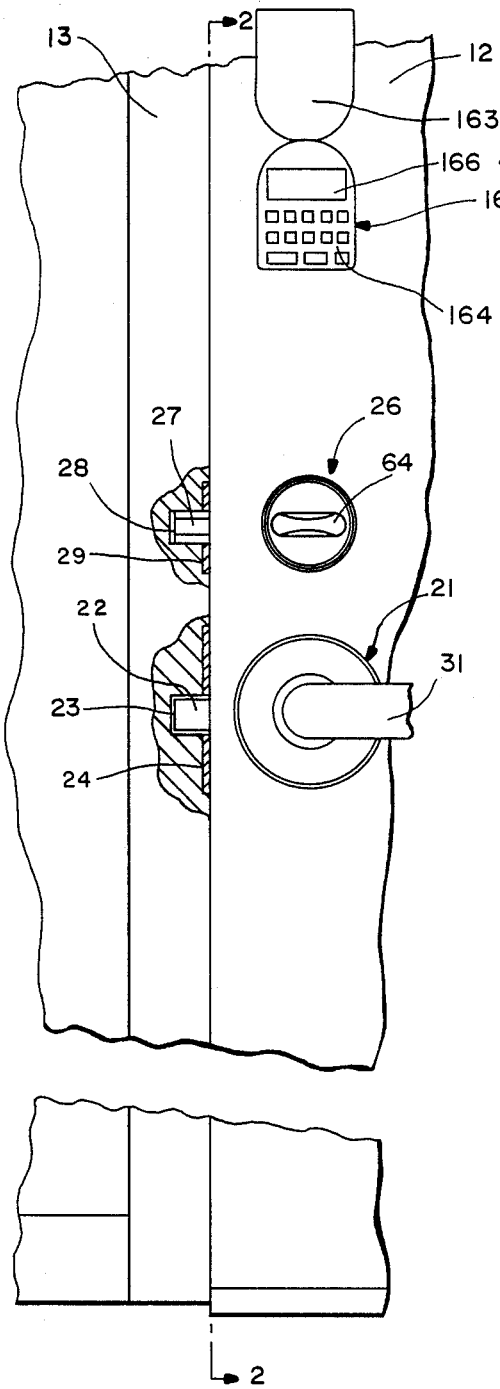
FIG. 1 is a partial view of the outside surface of a door in a closed position in a door frame incorporating the electronic lock apparatus and system of the present invention.

In general, the electronic door lock system incorporating the present invention is for use with a door mounted in a door frame with the door frame having a recess formed therein. The door lock system includes a latch mechanism adapted to be mounted on the door and having a latch movable between a door latching position in which it is disposed within the recess in the door frame and a door unlatched position in which the latch is free of the recess in the door frame. The latch mechanism includes a member adapted to be engaged by the human hand. Means is provided for interconnecting the member to the latch for moving the latch between the latched and unlatched positions. The interconnecting means includes electrically operated means for moving the interconnecting means between operative and inoperative positions. A control unit adapted to be mounted on the outside of the door is provided and includes a built-in key pad and self-contained battery operated electronic circuitry and an LCD display. Means is provided for electrically connecting the electronic circuitry of the control unit to the electrically operated means of the interconnecting means.

More in particular, the electronic door lock apparatus and system 11 incorporated in the present invention is for use with a door 12 which is mounted in a door frame 13. The frame 13 can be a conventional wood or metal frame which is mounted in an opening that provides access to an enclosed space. The door 12 is mounted for swinging movement about a vertical axis by hinges (not shown).

The electronic door lock apparatus and system 11 includes a first door latch mechanism 21 having a spring loaded movable latch 22 movable between door latching and unlatching positions by engaging a recess 23 provided in the door frame and in the strike 24 mounted in the door frame. Similarly, an additional latch mechanism 26 is provided in the form of a dead bolt 27 which is adapted to be moved between latching and unlatching positions with respect to a recess 28 provided in the door frame 13 and in a plate 29 in the door frame 13.

The latch mechanism 21 is of a conventional type and will now be described in detail. It is provided with handles 31 which are provided on both sides the outside and the inside of the door 12 for operating the latch 22.

The additional latch mechanism 26 (see FIG. 6) is also in part substantially conventional. The bolt 27 is cylindrical and is slidably mounted in a sleeve 32 affixed to a front plate 33. The front plate 33 is mounted on the door 12 by suitable means such as screws 34.

Figure 6:
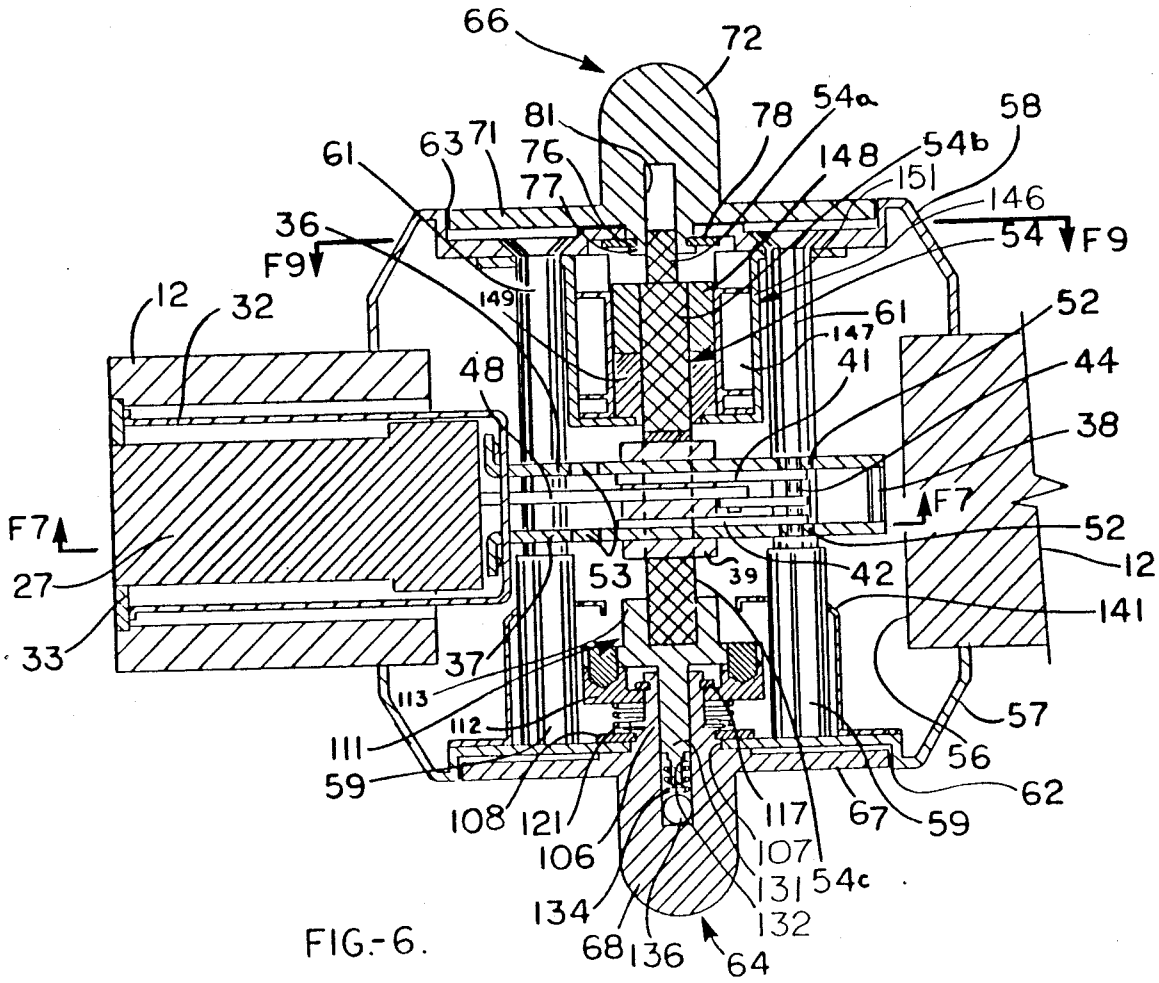
FIG. 6 is a cross-sectional view taken along the line 6—6 of FIG. 2.
Figure 7:
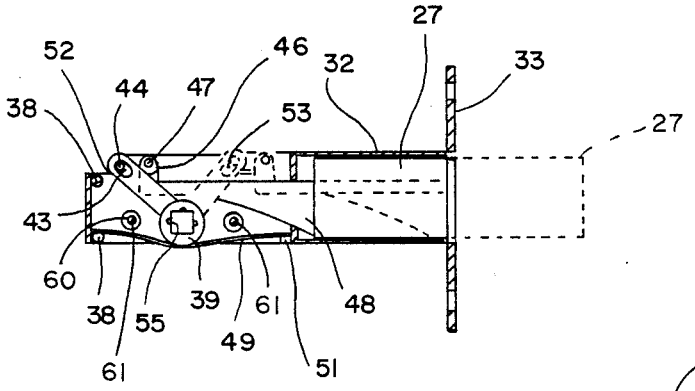
FIG. 7 is a cross-sectional view taken along the line 7—7 of FIG. 6.

The additional latch mechanism 26 includes spaced apart parallel frame members 36 and 37 (see FIG. 6) which have their front ends secured to and carried by the sleeve 32. Pins 38 interconnect the rear extremities of the frame members 36 and 37. A collar 39 is rotatably mounted in the frame members 36 and 37 and has arms 41 and 42 press fitted thereon. The outer extremities of the arms are provided with elongate slots 43 (see FIG. 7) that receive a pin 44 carried by a link 46. The link 46 is connected by a pin 47 to a bar 48 that is fixed to the rear extremity of the bolt 27. A leaf spring 99 engages the collar 39 and has one end supported by one of the pins 38 and the other end supported by a tab 51 mounted on the frame member 36. The pin 44 is adapted to seat in slots or recesses 52 and 53 provided in the frame members 36 and 37 and prevents the dead bolt 27 from being advanced or retracted when the pin 44 is seated in the slots. Rotation of the collar 39 causes the pin 44 to move in the slots 43 to clear the slots or recesses 52 and 53 so that the dead bolt 27 can be moved between extended and retracted positions. A solenoid rod or shaft 54 is provided. The shaft is provided with a mall square portion **54*a*, a circular portion 54*b* and a larger square portion 54*c*. As shown in FIG. 6, the solenoid rod or shaft 54 extends through the collar 39 which is provided with a substantially square hole 55 that is adapted to receive the square portion 54*c* of the solenoid rod or shaft 54. Thus it can be seen that by rotation of the solenoid rod or shaft 56, the collar 39 can be rotated to advance and retract the dead bolt 27**.

The additional latch mechanism 26 is adapted to be mounted in an opening 56 of a conventional size, as for example, $2\frac{1}{8}$ inches in diameter. The additional latch mechanism 26 includes an outside base or escutcheon 57 and an inside base or escutcheon 58 which is adapted to be mounted on the door 12 on opposite sides of the opening 56 to close off the opening and to provide an attractive or decorative appearance to the additional latch mechanism 26.

The outside base 57 is provided with a pair of bosses 59 which are adapted to receive screws 61 which extend through the inside circular base 58 and are threaded into the bosses 59 to retain the bases or escutcheons 57 and 58 on the door. The screws 61 extend through holes 60 (see FIG. 7 ) provided in the frame members 36 and 37.

Figure 9:
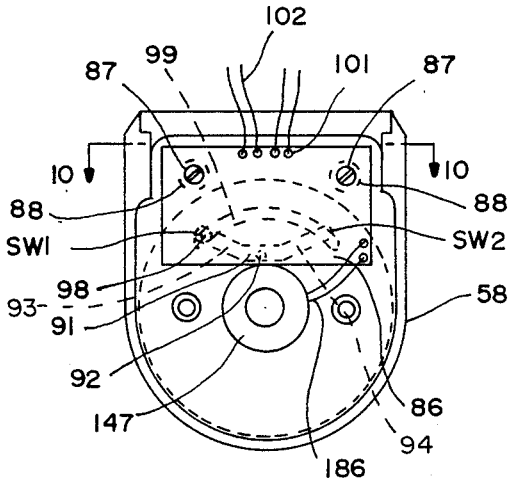
FIG. 9 is a cross-sectional view taken along the line 9—9 of FIG. 6.
Figure 10:
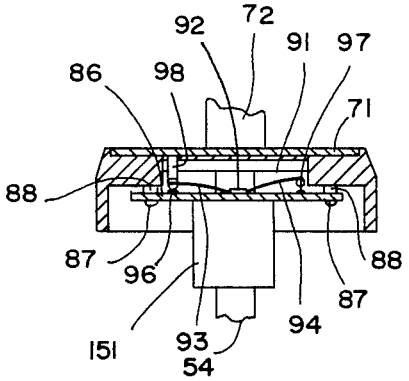
FIG. 10 is a cross-sectional view taken along the line 10—10 of FIG. 9.

The bases 57 and 58 are provided with circular recesses 62 and 63. An outside handle or knob 64 is mounted in the recess 62 and an inside handle or knob 66 is mounted in the recess 63. The handles or knobs 64 and 66 have a similar configuration. The handle or knob 64 is provided with a circular plate 67 which has a semi-cylindrical protrusion 68 extending perpendicular to the plate 67 that is formed integral with the plate 67. The protrusion 68 is adapted to be grasped by the human hand to rotate the same. Similarly, the handle or knob 66 is provided with a circular plate 71 which eats in the recess 63 and has a semi-circular protrusion 72 extending perpendicular thereto to serve as a knob or handle which can be grasped by the human hand. The handle or knob 66 is retained by an E-ring 76 which engages a boss 77 and is seated in a circular recess 78. The knob or handle 66 is also provided with a recess 81 which is square in cross section which is adapted to receive a square portion **54*a* of the solenoid rod or shaft 54. A PC board 86 (see FIGS. 9 and 10) is secured to the inside base or escutcheon 58 and is secured thereto by suitable means such as screws 87 extending into standoffs 88. An arcuate spring contact member 91 is secured to the PC board 86 by a clip 92. The contact member 91 is provided with contact arms 93 and 94 which are adapted to be moved into engagement with contacts 96 and 97 mounted on the PC board by a pin 98 which is mounted in a suitable manner such as by a press fit in the plate 71 of the handle or knob 66. The pin 98 extends through an arcuate slot 99 (see FIG. 9) provided in the inside base 58. Thus it can be seen that when the handle or knob 66 is rotated by 90°, the pin 98 will be moved from one end of the slot 99 to the other end of the slot 99 to permit one contact made by the arm 94 to open to thereby open switch SW2 and to close the other contact made by the arm 93 to thereby close switch SW1 for a purpose hereinafter described. The PC board 86 carries additional contacts 101 which are connected to a plurality of wires 102** which are utilized for a purpose hereinafter described.

The handle or knob 64 is provided with a boss 106 (see FIG. 6) which is provided with an annular recess 107 which receives an E-ring 108 that retains the knob 64 on the outside base or escutcheon plate 57.

A clutch assembly or means 111 (see FIG. 6) is provided for establishing a positive connection between the knob 64 and the solenoid rod or shaft 54. This clutch means and 111 includes first and second clutch plates or members 112 and 113 (see FIG. 8) which are adapted to mate with each other to establish a relationship in which one will rotate with the other. The first clutch plate or member 112 is provided with a square or rectangular opening 114 which is adapted to mate with a square extension 116 provided on the boss 106 of the knob 64 and is retained thereon by an E-ring 117 (see FIG. 6) seated in an annular recess 118. A coil spring 121 is provided between the rear side of the clutch plate 112 and the outside base or escutcheon plate 57 and serves to yieldably urge the first clutch plate 112 towards a stop provided by the E-ring 117. The first clutch plate 112 is provided with a front surface 122 which is undulating to provide hills and valleys. A plurality of holes 123 are provided in the first clutch plate 112 and are equally spaced circumferentially around the outer margin of the first clutch plate 112. Thus the holes can be spaced at 45° intervals to provide eight holes. As shown, the holes 123 have their centers disposed in the valleys of the undulating surface 122. These valleys are created by inclined portions **122*a* and 122*b* disposed on opposite sides of each of the holes which are inclined downwardly toward the hole. The portions 122*a* and 122*b* are of equal width and extend approximately halfway between each of the holes so that in between each pair of holes there is a ridge 124. The slope of the portions 122*a* and 122*b*** range from 5° to 15° and preferably should be approximately 10°.

The second clutch plate 113 is provided with a suitable number of holes, as for example, four holes which are spaced apart equally circumferentially around the outer margin of the second clutch plate 113. Pins 127 are mounted in the holes 126 by suitable means such as by a press fit. The pins 127 are cylindrical in shape and are provided with tapered conical tips **127*a* which face the undulating surface 122 of the first clutch plate 112. The conical tips 127*a*** can have a suitable taper, as for example, a taper of approximately 30°.

Figure 8:
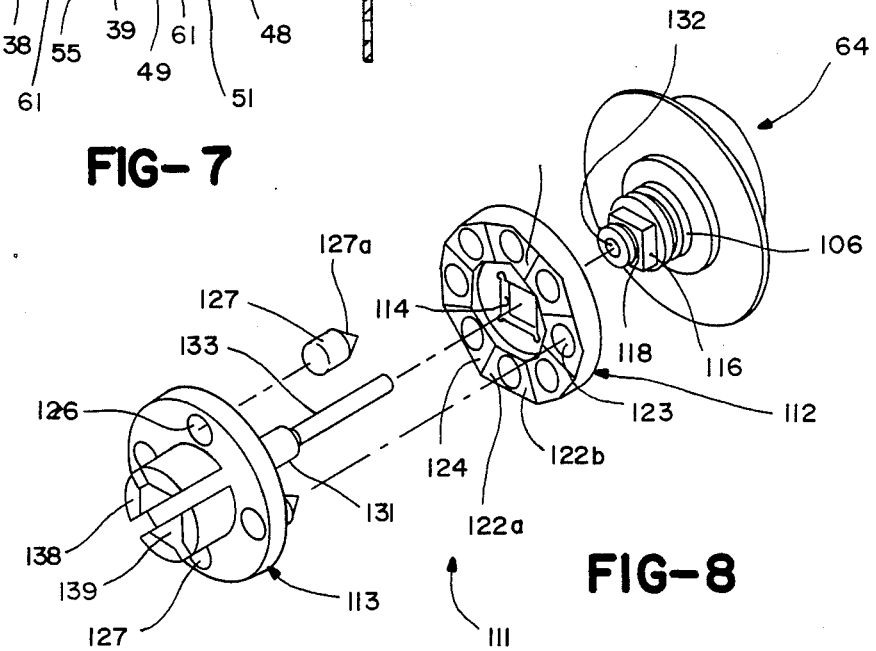
FIG. 8 is an exploded view of the clutch mechanism shown in FIG. 6.

The second clutch plate 113 is with a centrally disposed cylindrical extension 131 see FIG. 8 which extends at right angles from the clutch plate 113 and which extends through a bore 132 provided in the boss 106 of the knob or handle 64. The outer extremity of the cylindrical extension 131 is provided with an annular recess 133 which receives a coil spring 134 (see FIG. 6). The outer extremity of the coil spring 134 engages a ball 136 which is disposed within the bore 132. This coil spring 134 serves to yieldably urge the second clutch plate 113 upwardly as viewed in FIG. 6 and out of engagement with the first clutch plate 112. The second clutch plate 113 is also provided with a segmented boss 138 disposed on the side of the second clutch plate opposite the cylindrical extension 131. The boss 138 is provided with a bore or hole 139 which is square in cross section and receives the square portion **54*c* of the solenoid rod or shaft 54**.

A clutch assembly cover 141 (see FIG. 6) is provided for enclosing the clutch mechanism III and is secured to the outside base 57 in a suitable manner, such as by push nuts (not shown) engaging protrusions (not shown) extending through the cover 141.

Means is provided for moving the second clutch plate 113 into engagement with the first clutch plate 112 against the force of the spring 134 and consists of solenoid operated means 146 (see FIG. 6) which includes a wire wound solenoid bobbin 147 that is cylindrical in shape. An iron core amature 148 is press fitted to the solenoid rod or shaft 54 and is movable in the bobbin 147 under the influence of magnetic flux created between a fixed iron pole piece 149 and the armature 148. The pole piece 149 limits travel of the shaft 54 to a predetermined distance necessary to permit engagement of the clutch plates 112 and 113. When the solenoid bobbin 147 is energized as hereinafter described, the solenoid rod or shaft 54 will be moved in an axial direction to cause the compression of the spring 134 and to move the second clutch plate or member 113 toward the first clutch plate or member 112 to cause mating engagement between the same. A solenoid cover 151 is provided and encloses the solenoid and is secured to the inside base plate or escutcheon plate 58 by suitable means such as push nuts mounted on protrusions (not shown. When the solenoid operated means 146 is deenergized the spring 134 pushes the second clutch plate 113 out of engagement with the first clutch plate 112 and against the stop provided by the inwardly extending portion of the cover 141.

Figure 4:
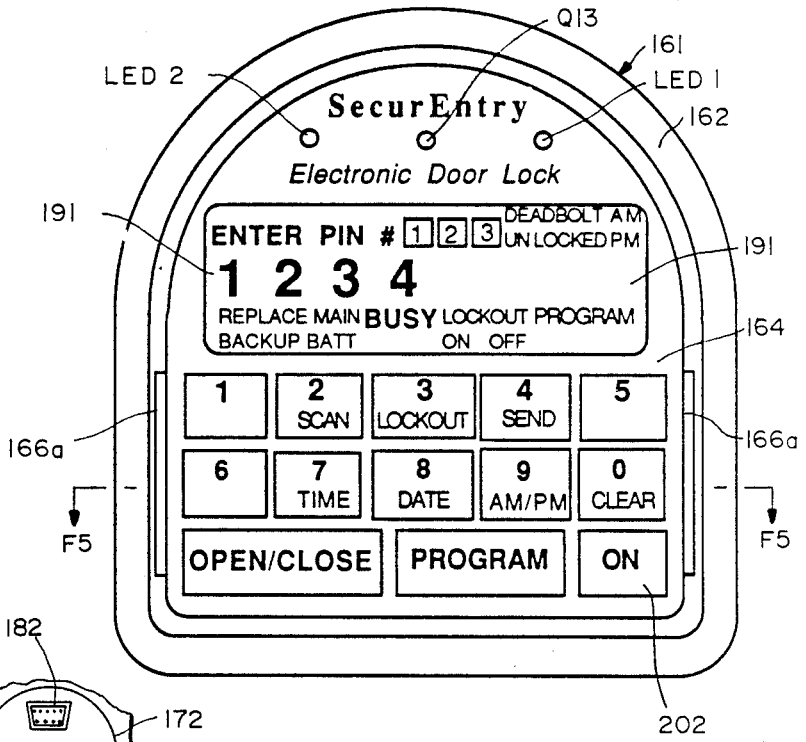
FIG. 4 is an enlarged plan view of the control console shown in FIG. 1.

The electronic door lock apparatus and system of the above invention also includes a control box or console 161 which is mounted on the outside surface of the door in a desired location, as for example, a distance of 6 to 12 inches above the additional latch mechanism 26 as shown in FIG 1. The control box 161 includes a metal housing or case 162 (see FIG. 5) which has a tombstone configuration and which is provided with a hinged cover 163 which can be swung to an open position by moving the same upwardly as shown in FIG. 1. A key pad assembly 164 and a liquid crystal display 166 are disposed within the housing 162 as shown in FIGS. 1 and 4. The key pad assembly 164 is provided with 13 key pads which have been identified in the manner shown in FIG. 4 and which are used in the manner hereinafter described.

Figure 5:
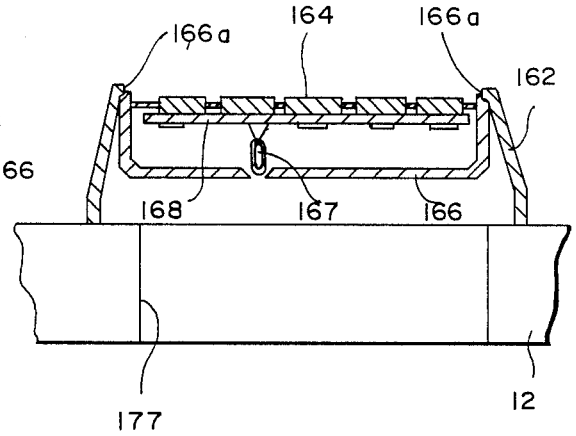
FIG. 5 is a cross-sectional view taken along the line 5—5 of FIG. 4.

In order to make the key pad assembly 164 visible in poor ambient light or in darkness, means has been provided for illuminating the same and consists of a light pipe 166 (see FIG. 5) which is of a generally U-shaped configuration shown in FIG. 5 and has its upper extremities **166*a* extending upwardly along the case 162 and extending slightly above the key pad assembly 164. Light is introduced into the light pipe by use of a lamp 167 which is carried by a printed circuit board 168 immediately behind the key pad assembly 164. The lamp 167** is energized in the manner hereinafter described.

Figure 2:
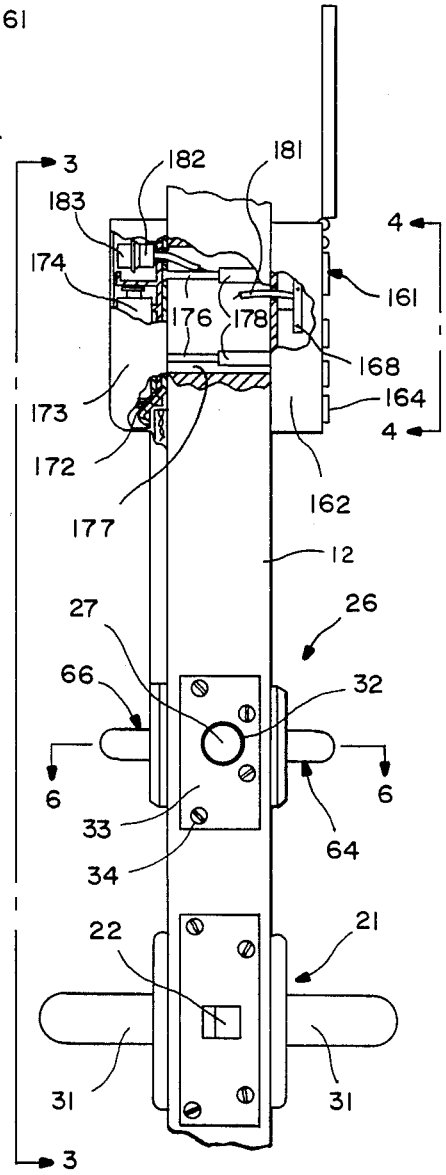
FIG. 2 is a view of the front edge of the door shown in FIG. 1 looking along the lines 2—2 of FIG. 1.

A battery enclosure housing or case 172 (see FIG. 2) is provided on the inside surface of the door opposite the control box 161 and is provided with a removable cover 173. A pair of batteries 174 of a suitable voltage such as 9 volts are provided within the battery enclosure. The control box 161 and the battery enclosure 172 can be secured to the door 12 in a suitable manner. For example, screws 176 can be provided in the housing or case 172. The screws 176 extend through a hole 177 provided in the door 12 and be threaded into bosses 178 provided on the housing 162.

Figure 3:
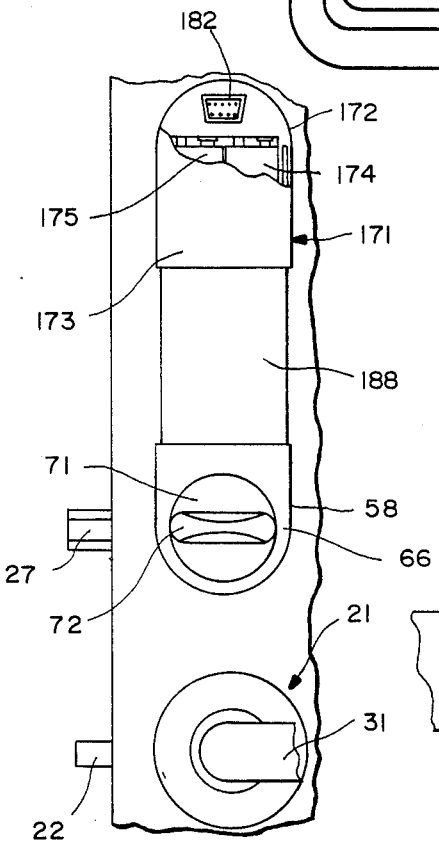
FIG. 3 is a view showing the inside surface of the door shown in FIG. 1 in a closed position in a door frame.

The key pad assembly 164 is connected by cabling 181 (see FIG. 2) extending through the hole 177 and is connected to a terminal 182 (see FIGS 2 and 3) mounted in the housing 172. The terminal 182 is connected to a connector 183 which is connected to conductors (not shown) making contact with the batteries 174 and with the wires 102 (see FIG. 9) connected to the printed circuit board 168. The printed circuit board 168 is also connected by the wires 102 to the bobbin 147. The wires 102 extend within an elongate trim plate or enclosure 188 which extends between the inside base or escutcheon 58 and the battery enclosure 172.

Figure 11:
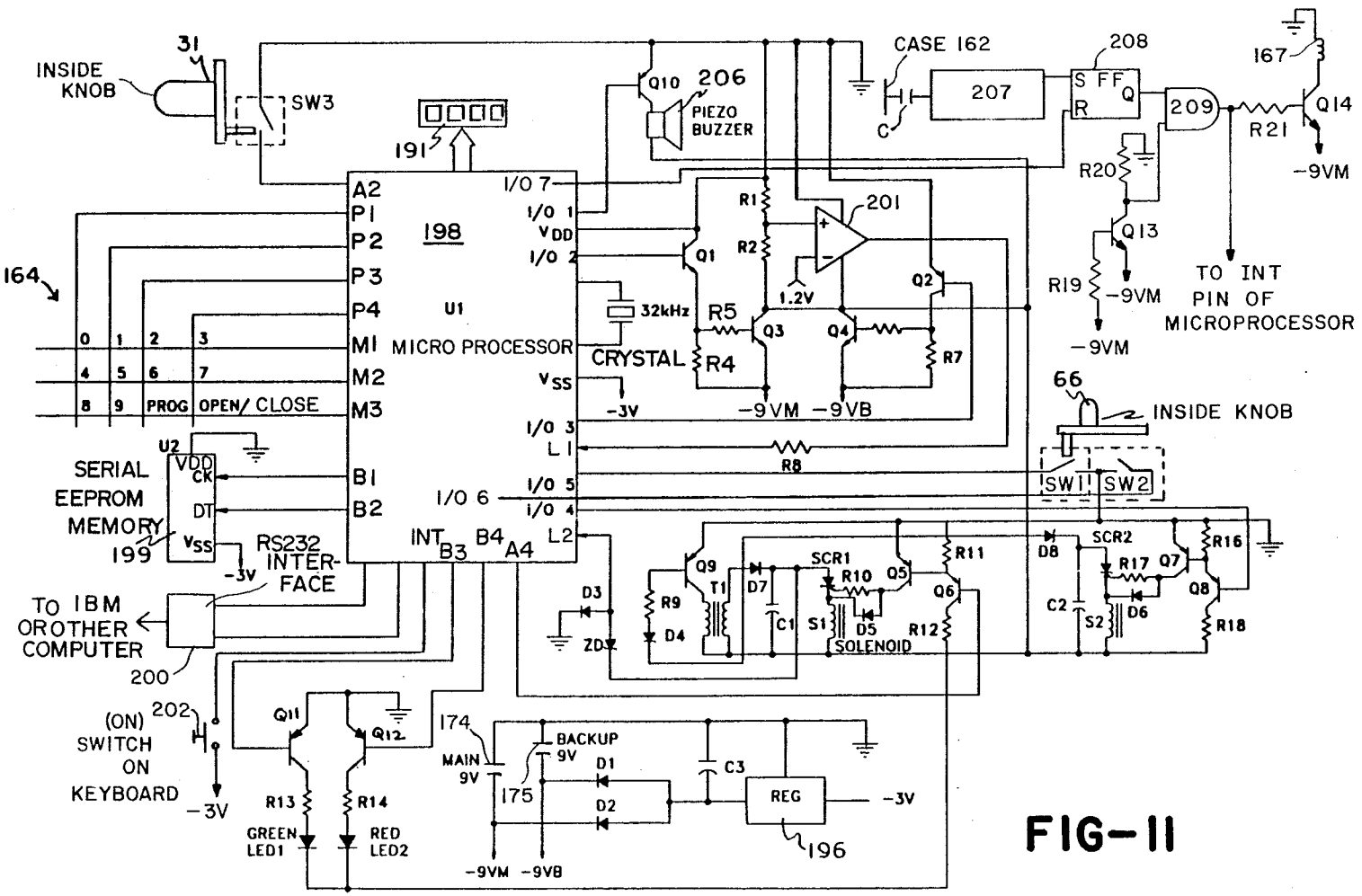
FIG. 11 is a circuit diagram showing the electronic circuitry which is utilized in the apparatus and system shown in FIGS. 1—10.

The printed circuit board 168 has provided thereon the circuitry which is shown in FIG. 11. The printed circuit board includes two light emitting diodes, LED2 and LED1 (see FIG. 4), which are visible above the key pad assembly 164 and above a liquid crystal display 191.

The batteries 174 and 175 are shown on the circuit diagram in FIG. 11 with battery 174 being the main 9-volt battery supply and the battery 175 being the back-up 9 volt battery supply. The output voltages from the batteries in addition to supplying the minus 9 volts main and the backup respectively also supply voltages through diode D1 and D2 through a filter capacitor C3 through a regulator 196 to provide an output voltage of minus 3 volts which is also utilized in the circuitry. A microprocessor 198 forms a part of the circuitry and can be of a suitable type such as a four bit or an eight bit microprocessor. As shown, the microprocessor 198 is connected to the liquid crystal display 191. The microprocessor 198 is provided with various terminals as indicated It is connected to the key pad assembly 164. It is also connected to a serial EEPROM memory 199 which prevents loss of access codes and other stored information in the memory in case of battery failure or during replacement of batteries. It is also connected by cabling to an RS 232 interface 200 so that the printed circuit board can be connected to other types of electronic equipment, as for example, other computers. It is also connected to a comparator 201 of the low battery detect circuit and a buzzer 206.

Operation and use of the electronic door lock apparatus and system in performing the method of the present invention may now be briefly described as follows. Let it be assumed that the electronic door lock apparatus 11 has been installed in a home owner's door and that the dead bolt 27 has been moved to a locked position by the home owner at the time of leaving and that now the home owner has returned home and wishes to enter the house. The home owner raises the cover 163 on the control box 161 and then pushes the "on" push button which wakes up the microprocessor 198 so that it is capable of accepting the four digit code of the personal identification number (PIN) of the home owner. Assuming that the PIN number is 1-2-3-4, the home owner would push those push buttons and these numbers would appear on the liquid crystal display 166. Alternatively, these numbers could appear as "x's" so that they would not be visible to somebody observing the home owner operating the electronic door lock apparatus. Each time that the home owner presses a key, the red LED2 flashes to give a visual indication to the home owner that he had actually pressed a key. The microprocessor 198, after receiving the appropriate PIN number performs a battery test on both of the batteries 174 and 175. This is accomplished by means of the terminal I/O2 which supplies a voltage to the transistor Q1 which is turned on which turns on Q3 and to activate the low battery detect circuit comprised of the comparator 201 having a fixed 1.2 volt reference. The comparator 201 compares the battery voltage of the 9 volt main battery since Q3 is connected to the minus 9 volts from the main battery 174 to provide a signal to the microprocessor 198 on the terminal S1 through a resistor R8 which limits the current to the input of the microprocessor. Resistors R1 and R2 connected to the microprocessor 198 serve as a voltage divider which sets the threshold at which a battery produces a sufficiently low voltage that it should be replaced The microprocessor reads information being supplied on the terminal S1 and if it finds that the voltage is too low, it will operate the REPLACE MAIN BATT message provided on the LCD display. Thereafter Q4 is turned on and a similar test is made on the backup battery 175 by connecting the comparator 201 to the minus 9 volts provided by the backup battery and again supplying it to the terminal S1 of the microprocessor which again reads the signal on the terminal S1 to determine whether or not the backup battery voltage is low. If it is low, the REPLACE BACKUP BATT indication on the liquid crystal display 166 will be energized. Thus it can be seen that these two messages on the liquid crystal display 191 will tell the user whether or not the batteries are low. In case the main battery 174 is low, the microprocessor will switch to the backup battery and it will continue to use that battery for solenoid operation during the remainder of the operations. The microprocessor 198 and the EEPROM memory 199 are both supplied with power from the regulated minus 3 volt output from the regulator 196. The diodes D1 and D2 serve to automatically switch from the main battery 174 or the backup battery 175 depending which has the higher voltage. This ensures that the microprocessor 198 and the memory 199 will always be operated from the battery having the higher voltage so that the performance of the same will not be degraded by a voltage drop which can occur during the operation of the circuitry for energizing the solenoid or solenoids in the latch mechanism 21 and the dead bolt 26.

The microprocessor 198 and the memory 199 will always operate on the battery having the higher voltage. Since both the microprocessor 198 and the memory 199 draw negligible amounts of power, it does not matter that they may be operating under the backup battery while the main battery is being utilized to supply the power for energization of the solenoid or solenoids.

It is desirable to check the voltage on the backup battery because it may not be used in any substantial amount for a year and a half during operation of the door lock apparatus. As explained previously, the microprocessor 198 first tests the main battery 174 by turning on transistors Q1 and Q3 through the I/O2 port and then by turning on the transistors Q2 and Q4 through the I/O3 terminal. If both batteries are good, the microprocessor will return to the I/O2 terminal to use the main battery for the rest of the operation. After the microprocessor has decided which battery is to be utilized for operating the solenoid or solenoids, either Q3 or Q4 will be turned on through the respective terminals from the microprocessor. Assuming that the main battery 174 has an adequate voltage, Q3 will be turned on which supplies power from the collector of Q3 through to the solenoid circuitry to charge the capacitors C1 and C2. After the capacitors C1 and C2 are charged they will be discharged through the silicon controlled rectifiers SCR1 and SCR2 in a manner described in U.S. Letters Pat. No. 4,777,556 to supply a high voltage to the solenoids S1 and S2 and also to provide holding currents through diodes D5 and D6 via the transistors Q5 and Q7 after the solenoid has moved the shaft or rod 54 to the actuated position.

The triggering of the solenoid circuitry is determined by the microprocessor 198. The circuitry for energizing the solenoid S1 for the dead bolt would be triggered by the base of Q6 which is connect ed to the A4 terminal of the microprocessor. Similarly, the triggering of the circuitry for energizing the solenoid for the door latch 22 is controlled by the base of transistor Q8 which is connected to the terminal I/O4 of the microprocessor 198. Typically the high voltage is applied to the solenoid for 30 to 40 milliseconds. The duration is based upon the value of the capacitance of the associated high voltage capacitor and the resistance of the solenoid. The holding current is maintained until the inside knob 66 is operated to open one switch of switches SW1 or SW2 and close the other switch of switches SW2 or SW1 when the knob 66 is rotated through 90° to move the dead bolt from the locked to the unlocked position or vice versa. The switches SW1 and SW2 inform the microprocessor in which position the inside knob 66 is positioned. As soon as the microprocessor has determined that the inside handle or knob has moved 90° from one switch to the other, the microprocessor shuts off the power to the dead bolt solenoid. In the case of the latch solenoid which is S2, this remains energized until switch SW3 is closed by the turning of the inside knob 31 of the door latch mechanism by 90°. This is done to conserve battery power.

It also should be pointed out that the microprocessor 198 has the capability of checking the condition of the main and backup batteries during the charging cycle by monitoring the output of the comparator 201 via input L1. The charging circuitry receives a −9 volt from the collector of either Q3 or Q4, whichever is turned on, depending on which battery the microprocessor decides to use and if it is ascertained that during the charging cycle that the voltage on the battery drops rapidly which could be the case when the battery is nearly depleted, that it will automatically cause the charging circuit for the solenoid to be energized to be switched to the other battery. This ensures that there will be adequate battery power to charge the capacitor for the solenoid circuitry to be operated.

In connection with the foregoing it can be appreciated that the solenoids S1 and S2 can be operated simultaneously if desired or, if desired, can be operated sequentially with the solenoid S1 being operated first and the solenoid S2 being operated second. In general, it is desirable to operate them sequentially so that the battery supply will not be overloaded by the necessity of energizing two solenoids simultaneously.

The "on" switch 202 for operating the microprocessor 198 is shown in the circuit diagram in FIG. 11 and wakes up the microprocessor. It is connected to the minus 3 volt supply.

As hereinbefore described the red LED2 shown in the circuit diagram in FIG. 11 is energized each time one of the keys on the key pad is depressed. The green LED1 is energized during the holding period of each of the solenoids S1 and S2 to indicate that the clutch mechanisms have been engaged and that the door can be opened by turning of the knob of the dead bolt or the knob of the door latch mechanism. This gives a visual indication to the user which is particularly useful at nighttime. The piezo buzzer 206 is also energized at the same time that the green LED1 is energized so that an audible indication is given to the user.

Also shown in FIG. 11 is the circuitry utilized for illuminating the key pad at night or poor ambient light conditions. This means consists of the metal case 162 which when touched by the human hand or finger changes the capacitance of the metal case as represented by the capacitance c which is sensed by a conventional signal conditioning circuitry 207 for a capacitor switch which produces a pulse which is supplied to a set-reset flip-flop 208. The flip-flop 208 supplies a signal to the AND gate 209 which is connected to a transistor Q14. For the transistor Q14 to be turned on another input of the AND gate must be energized from the photo transistor Q13. This causes transistor Q14 to be turned on which supplies energy to an incandescent lamp 167. The light from the lamp 211 is guided by the light pipe 166 to illuminate the key pad assembly 164. At the same time the signal is supplied from the AND gate output to the INT pin of the microprocessor 198 to wake up the microprocessor. After the microprocessor has caused operation of either or both of the solenoids S1 and S2, or if a time-out has occurred, a signal is supplied from the terminal I/O7 to the set-reset flip-flop 208 to reset the flip-flop 208 and to turn off the lamp 167 supplied with energy from the transistor Q14. The lamp 167 for the light pipe 166 can only be supplied with power from the main battery. Thus the backup battery always remains available for operating the microprocessor 198 and the solenoids S1 and S2 so that the door can be opened.

At the time a home owner wishes to leave his home and to lock the door, a sequence of operations similar to that hereinbefore described must be accomplished by the home owner to position the dead bolt in an extended position. To do this it is merely necessary for him to press the ON button and then to press the OPEN/-CLOSE button. Since the microprocessor knows that the dead bolt is unlocked by the position of the switches SW1 and SW2, there is no requirement that the PIN number of the owner be inserted to activate the solenoids to operate the clutch mechanisms Thus, there has been provided a simplified procedure for locking of the door when the home owner leaves. It is only necessary to insert the PIN number of the owner when the owner wishes to enter the premises.

In addition to permitting locking of the door, the apparatus, system and method of the present invention has many additional capabilities. Various functions can be programmed into the microprocessor by depressing the PROGRAM key with a combination of other keys to provide three levels of access codes. For example, a master code can be provided which is a single code which allows the owner to open and lock the apparatus and also to program access codes and to program other functions of the lock. As many as 9,000 access codes can be provided which are easily programmed by the owner allowing access during non-lock-out hours. Up to 50 of such access codes can be active at one time. In addition, single one-time access codes can be programmed to permit only one entry. This can be useful for giving to repairman and the like who only need one entry into the premises.

Utilizing the master code the owner can display and review all access codes to determine which codes are active. Twenty-four hour lock-out capability can be programmed using the master code to limit access to the property during a predetermined 24 hour period. The master code can also be utilized for setting both date and time to appear on the LCD display. Using the master code, the owner can also set the lock-out hours for the access codes except for the master code, as for example, from 8:00 p.m. to 7:00 a.m. Also utilizing the master code the owner can display the date, time and access code of a last predetermined number of entries, as for example, the last ten entries to the apparatus to provide additional security and accountability.

The apparatus, system and method requires no special skills or tools. The apparatus is as easy to install as an ordinary dead bolt. Since the system is battery operated no complex wiring is required. The system is self-contained and does not require external power to be supplied to the door other than the batteries contained within the unit itself. Typically the two 9-volt batteries should operate the electronic door apparatus for at least one year. Battery replacement can be readily accomplished from the inside of the door. This entry review can be obtained by pressing the "send" push button. The identifications on the various key pads are self explanatory. The LCD display is typically blank and only the message which is pertinent at the time will be displayed. For example, when the microprocessor is first turned on the ENTER PIN NUMBER message will appear in the display and then the PIN number can be displayed as "x's" or as the actual numbers. The indicia appearing to the right of the ENTER PIN NUMBER or 1-2-3 indicate the first, second and third levels of access code with the first level being the master code, the second level being the access codes and the third level being the one-time access code. To the right of that appears the designation "dead bolt unlocked". When the dead bolt is locked it will say "dead bolt locked" and when it is unlocked, it will give the message "dead bolt unlocked". The "AM" and "PM" designation will only appear during time and date programming. Similarly, below the PIN number display, a message can be given which would read "REPLACE MAIN BATTERY" or "REPLACE BACKUP BATTERY". Another designation will appear as "BUSY" which is the time that is required for charging up the high voltage capacitor for the solenoid. This will indicate to the outsider that the apparatus is functioning. Then to the right of that appears "LOCK OUT ON/-OFF". The "LOCK-OUT ON/OFF" displays the message that if someone is attempting to get in and that time is inappropriate because of the time lock-out provided by the owner, this message will be given to the person attempting to enter the premises. It also will indicate "LOCK-OUT OFF" when the premises are open for inspection by the person having the access code. The PROGRAM designation message is displayed when the device is in the program mode during the programming of the various functions.

It is apparent from the foregoing that there has been provided an improved electronic door lock apparatus, system and method which has many capabilities.

We claim:

1. In an electronic door lock system free of externally accessible keyways for use with a door mounted in a door frame in which the door has an outside and an inside, the door frame having first and second recesses formed therein, a dead bolt mechanism adapted to be mounted on the door and having a dead bolt movable between a door latched position in which it is disposed in the first recess in the door frame and door unlatched position in which the dead bolt is free of the first recess in the door frame, a latch mechanism adapted to be mounted on the door and having a latch movable between a door latched position in which it is disposed in the second recess in the door frame and a door unlatched position in which the latch is free of the second recess in the door frame, first and second hand-operated members adapted to be mounted on the outside of the door and adapted to be engaged by the human hand, first interconnecting means interconnecting said first hand-operated member to said dead bolt, second interconnecting means interconnecting said second hand-operated member to said latch for moving said latch between latched and unlatched positions, said first and second interconnecting means each including electrically operated means movable between a first operative position and a second inoperative position, a control unit adapted to be mounted on the door in the vicinity of said dead bolt mechanism and said latch mechanism said control unit including at least two batteries and electronic circuitry connected to said batteries and means electrically connecting the electronic circuitry of the control unit to the electrically operated means of the first and second interconnecting means, said control unit including means for selectively energizing the electrically operated means of the first and second interconnecting means so that said dead bolt and said latch can be moved to unlatched positions under the control of the first and second hand-operated members.

2. A system as in claim 1 wherein said control unit includes a key pad and a microprocessor coupled to the key pad for receiving information from the key pad.

3. A system as in claim 1 wherein each of said electrically operated means includes a solenoid and means for supplying a high voltage to the solenoid to cause operation of the solenoid.

4. In an electronic door lock system for use with a door mounted in a door frame, the door frame having a recess formed therein, a latch mechanism adapted to be mounted on the door and having a latch movable between a door latched position in which it is disposed in the recess in the door frame and a door unlatched position in which the latch is free of the recess in the door frame, a member adapted to be engaged by the human hand, interconnecting means interconnecting said member to said latch for moving said latch between latched and unlatched positions, said interconnecting means including means movable between a first operative position and a second inoperative position, a control unit adapted to be mounted on the door in the vicinity of said latch mechanism and including self-contained electronic circuitry and means for electrically connecting the electronic circuitry of the control unit to the electrically operated means of the latch mechanism, said electronic circuitry including first and second batteries, means coupled to the microprocessor for testing each of the batteries sequentially to ascertain which battery provides the higher voltage and whether or not each of the batteries provides a voltage which is above a predetermined threshold voltage and means for connecting the first of said batteries to the electrically operated means of the latch mechanism until the voltage supplied by that battery is below a predetermined threshold voltage.

5. A system as in claim 4 together with means connected to the microprocessor for selecting from the first and second batteries the battery having the highest voltage for operation of the microprocessor.

6. A system as in claim 4 wherein said microprocessor includes means for automatically checking the voltage on the first and second batteries during the time that energy is being supplied to the electrically operated means and if the battery voltage drops below a predetermined level to switch to the other battery so that adequate power is available for operation of the electrically operated means.

7. In an electronic door lock system for use with a door mounted in a door frame, the door frame having a recess formed therein, a latch mechanism adapted to be mounted on the door and having a latch movable between a door latching position in which it is disposed in the recess in the door frame and a door unlatched position in which the latch is free of the recess in the door frame, a member adapted to be mounted on the door and adapted to be engaged by the human hand, means interconnecting said member to said latch for moving said latch between latched and unlatched positions, said interconnecting means including means movable between a first operative position and a second inoperative position, a control unit adapted to be mounted on the door in the vicinity of said latch mechanism and including self-contained electronic circuitry and means for electrically connecting the electronic circuitry of the control unit to the electrically operated means of the latch mechanism, said electronic circuitry including a key pad assembly mounted on the door in the vicinity of said member and means carried by the key pad assembly operable by the human hand for illuminating the key pad assembly only when the ambient light in the vicinity of the key pad assembly is inadequate to permit viewing of the key pad assembly.

8. In an electronic door lock system for use with a door mounted in a door frame, the door frame having a recess formed therein, a latch mechanism adapted to be mounted on the door and having a latch movable between a door latching position in which it is disposed in the recess in the door frame and a door unlatched position in which the latch is free of the recess in the door frame, a member adapted to be engaged by the human hand, means interconnecting said member to said latch for moving said latch between latched and unlatched positions, said interconnecting means including means movable between a first operative position and a second inoperative position, a control unit adapted to be mounted on the door in the vicinity of said latch mechanism and including self-contained electronic circuitry and means for electrically connecting the electronic circuitry of the control unit to the electrically operated means of the latch mechanism, said electronic circuitry including a key pad assembly mounted on the door and means carried by the key pad assembly for illuminating the key pad assembly when the ambient light in the vicinity of the key pad assembly is inadequate to permit viewing of the key pad assembly, said means for illuminating the key pad assembly including a light pipe, a lamp for supplying light to the light pipe and a photo sensor for sensing ambient light and capacitive means adapted to be energized by the presence of a human hand to energize the lamp.

9. A system as in claim 8 wherein said means adapted to be energized by the human hand includes a metal housing for the key pad assembly.

10. A system as in claim 8 together with a light emitting diode for giving an indication each time a key pad is actuated and an additional light emitting diode which is energized when energy is supplied to the electrically operated means.

11. In an electronic door lock apparatus for use with a door mounted in a door frame in which the door has an inside and an outside, the door frame having a recess formed therein, a latch adapted to be mounted on the door and being movable between a door latched position in which it is disposed in the recess in the door frame and a door unlatched position in which the latch is free of the recess in the door frame, first and second hand-operated members adapted to be grasped by the hand and adapted to be mounted on opposite sides of the door, said first hand-operated member being adapted to be mounted on the inside of the door and said second hand-operated member being adapted to be mounted on the outside of the door, a clutch mechanism including first and second clutch members movable between engaged and disengaged positions, shaft means extending between the first and second hand-operated members, means coupling the shaft means to the latch whereby when the shaft means is rotated, the latch is moved between said latched and unlatched positions, means coupling the shaft means to the first hand-operated member, means coupling the shaft means to the first clutch member, means coupling the second hand-operated member to the second clutch member, a stop carried by the second hand-operated member, first spring means carried by the second hand-operated member and yieldably urging the second clutch member towards said stop, second spring means yieldably urging said first clutch member out of engagement with said second clutch member and electrically operated means for moving the first clutch member into engagement with the second clutch member against the yieldable forces of the first and second spring means so that the second hand-operated member can be utilized for moving the latch from a latched to an unlatched position.

12. Apparatus as in claim 11 wherein said electrically operated means for moving said first and second clutch members into engagement with each other includes solenoid operated means and in which the shaft means is disposed coaxially of the solenoid operated means.

13. Apparatus as in claim 11 wherein said means coupled to said shaft means for causing operation of said latch includes a collar, wherein said shaft is slidably mounted in said collar for movement axially of the collar and wherein said shaft and said collar include cooperative means for preventing rotation of the collar independently of the shaft.

14. Apparatus as in claim 13 wherein said shaft means is movable axially of the second hand-operated member, said second clutch member including means for establishing a connection between the shaft and the second clutch member whereby when the shaft is rotated the second clutch member is rotated, said first clutch member being secured to said first hand operated member for rotation with the first hand operated member.

15. Apparatus as in claim 11 wherein said first clutch member is provided with an undulating surface having hills and valleys, said first clutch member having circumferentially arranged holes extending therethrough in the valleys, said second clutch member having a plurality of pins circumferentially disposed around the second clutch member, said pins having conically tapered extremities, said pins being of a size so as to be adapted to fit in the holes of the second clutch member.

16. In a method for operating a door lock system adapted to be mounted on a door disposed in a door frame with the door frame having a recess mounted therein and having a latch movable between a door latched position when it is disposed in the recess in the door frame and in a door unlatched position when it is free of the recess in the door frame and first and second hand-operated members adapted to be operated by the hand with first member being mounted on the outside of the door and the second member being mounted on the inside of the door with means interconnecting the first and second hand operated members with the latch whereby the latch can be moved between the latched and unlatched positions, the interconnecting means including electrically operated means movable between a first operative and a second inoperative position, the electrically operated means including first and second batteries, the interconnecting means having a normally inoperative position, the method comprising the steps of automatically testing the voltage on each of the first and second batteries to ascertain which of the batteries produces a higher voltage and whether each of the batteries provides a voltage above a predetermined threshold voltage and using the first battery to supply power to the electrically operated means as long as the voltage output from the first battery exceeds a predetermined voltage.

17. A method as in claim 16 where the electronic circuitry includes a microprocessor together with the step of selecting the battery having the higher voltage for supplying power to the microprocessor.

18. In a method for operating a door lock system adapted to be mounted on a door disposed in a door frame with the door frame having a recess mounted therein and having a latch movable between a door latched position when it is disposed in the recess in the door frame and in a door unlatched position when it is free of the recess in the door frame and first and second hand-operated members adapted to be operated by the hand with first hand-operated member being mounted on the outside of the door and the second hand-operated member being mounted on the inside of the door with means interconnecting the first and second hand operated members with the latch whereby the latch can be moved between the latched and unlatched positions, the interconnecting means including electrically operated means movable between a first operative and a second inoperative position, the interconnecting means having a normally inoperative position, the method comprising the steps of energizing the electrically operated means for a predetermined period of time, the electrically operated means including electronic circuitry having a key pad assembly together with the step of sensing the ambient light in the vicinity of the key pad assembly and supplying illumination to the key pad assembly when the ambient light falls below a predetermined level.

19. A method as in claim 18 together with the step of ascertaining when a human hand has come into contact with the key pad assembly and supplying illumination to the key pad assembly only when the ambient light falls below a predetermined level and when a human hand has come into contact with the key pad assembly.

* * * * *